US010597971B2

(12) United States Patent
Wubben

(10) Patent No.: US 10,597,971 B2
(45) Date of Patent: Mar. 24, 2020

(54) METHOD AND SYSTEM FOR INHIBITING CEMENT DEPOSITION IN A JACK AND PULL (JAP) EXPANSION ASSEMBLY

(71) Applicant: SHELL OIL COMPANY, Houston, TX (US)

(72) Inventor: Antonius Leonardus Maria Wubben, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 162 days.

(21) Appl. No.: 15/855,316

(22) Filed: Dec. 27, 2017

(65) Prior Publication Data

US 2018/0119515 A1 May 3, 2018

Related U.S. Application Data

(63) Continuation of application No. PCT/EP2016/065143, filed on Jun. 29, 2016.

(30) Foreign Application Priority Data

Jul. 1, 2015 (EP) ..... 15174875

(51) Int. Cl.
*E21B 33/16* (2006.01)
*E21B 43/10* (2006.01)
(Continued)

(52) U.S. Cl.
CPC ..... *E21B 33/16* (2013.01); *E21B 33/12* (2013.01); *E21B 33/14* (2013.01); *E21B 34/06* (2013.01); *E21B 34/10* (2013.01); *E21B 43/103* (2013.01); *E21B 43/105* (2013.01); *E21B 37/10* (2013.01); *E21B 2034/005* (2013.01)

(58) Field of Classification Search
CPC ..... E21B 43/103; E21B 43/105; E21B 33/16; E21B 37/10; E21B 34/10; E21B 34/06; E21B 33/12; E21B 33/14; E21B 2034/005
See application file for complete search history.

(56) References Cited

U.S. PATENT DOCUMENTS 2,426,164 A * 8/1947 Breukelman ..... E21B 33/14 166/146
3,260,309 A * 7/1966 Brown ..... E21B 33/14 166/124

(Continued)

OTHER PUBLICATIONS

International Search Report and Written Opinion received for PCT Patent Application No. PCT/EP2016/065143, dated Oct. 5, 2016, 10 pages.

*Primary Examiner* — Nicole Coy

(57) ABSTRACT

A hydraulically actuated Jack And Pull (JAP) tubular expansion tool string comprises:

an annular non-return valve arranged in the wall of the JAP string, which allows mud to flow from a surrounding annulus into the bore of the expansion tool string when the pressure in the bore of the tool string is lower than that in the annulus;

a second non-return valve arranged in the JAP string below the annular valve which allows fluid to move down only;

wherein during the cycling of the jack the annular non-return valve is continuously open and the second non-return valve cycles with the jack movement to inhibit curing of cement in the expansion tool string.

4 Claims, 2 Drawing Sheets

(51) Int. Cl.

| | |
|---|---|
| ***E21B 34/10*** | (2006.01) |
| ***E21B 33/12*** | (2006.01) |
| ***E21B 33/14*** | (2006.01) |
| ***E21B 34/06*** | (2006.01) |
| ***E21B 37/10*** | (2006.01) |
| ***E21B 34/00*** | (2006.01) |

(56) References Cited

U.S. PATENT DOCUMENTS

| | | | | |
|---|---|---|---|---|
| 6,009,943 | A * | 1/2000 | Yokley | E21B 23/04 166/123 |
| 7,552,772 | B2 * | 6/2009 | Carmody | E21B 17/1007 166/285 |
| 7,967,064 | B2 * | 6/2011 | Cook | E21B 43/103 166/207 |
| 7,987,905 | B2 * | 8/2011 | Adam | E21B 21/10 137/377 |
| 8,186,427 | B2 * | 5/2012 | Adam | E21B 21/10 166/207 |
| 8,393,389 | B2 * | 3/2013 | Brisco | E21B 34/14 166/217 |
| 9,410,399 | B2 * | 8/2016 | Andersen | E21B 34/14 |
| 10,087,725 | B2 * | 10/2018 | Giroux | E21B 33/14 |
| 2005/0194128 | A1 | 9/2005 | Campo | |
| 2006/0169460 | A1 | 8/2006 | Brisco | |

* cited by examiner

METHOD AND SYSTEM FOR INHIBITING CEMENT DEPOSITION IN A JACK AND PULL (JAP) EXPANSION ASSEMBLY

CROSS REFERENCE TO RELATED APPLICATIONS

This is a Continuation application of International Application PCT/EP2016/065143, filed 29 Jun. 2016, which claims priority of European application 15174875.3, filed 1 Jul. 2015.

FIELD OF THE INVENTION

The invention relates to a method and system for passing cement through a hydraulically actuated Jack And Pull (JAP) expansion tool string.

BACKGROUND OF THE INVENTION

It is known to expand a tubular downhole in a well using a Jack And Pull (JAP) assembly which is cyclically extended and retracted.

There is a need to provide an improved Jack And Pull (JAP) liner expansion tool that enables:

- The drill pipe to be cleaned during cementation by a two stage trailing cement plug provided with elastomer scrapers wiping the inner wall of the drill pipe.
- The second stage of the plug to be released from the first stage upon seating to close off the bore of the expansion assembly which allows the jack to be operated.
- The cement to be flushed from the bore of the expansion tool string below the jack through the use of an annular non-return valve and a non-return valve in the bore of the expansion tool string.
- The area below the cone to be filled with mud while stroking the jack.

It is an object of the present invention to provide an improved method and system that meet these objectives and overcome drawbacks of the known JAP assembly.

SUMMARY OF THE INVENTION

In accordance with on aspect of the invention, there is provided a method for passing cement through a hydraulically actuated Jack And Pull (JAP) expansion tool string, the method comprising:

providing a JAP tool string comprising a bore, a wall, and a hydraulic JAP jack comprising a piston and cylinder assembly which comprises a piston provided with a piston bore;

arranging an annular non-return valve in the wall of the JAP tool string below the hydraulic JAP jack, which allows mud to flow from a surrounding annulus into the bore of the JAP tool string when the pressure in the bore of the JAP tool string is lower than that in the surrounding annulus;

arranging in an interior of the JAP tool string, and below the annular non-return valve, a second non-return valve, which allows fluid to move only down through the bore from an upper part to a lower part of the interior of the JAP tool string;

pumping cement though the bore JAP tool string and the piston bore;

when cement is pumped a trailing plug assembly comprising an outer and an inner plug is pumped behind the cement column;

the outer plug subsequently seats and seals at a first seat at an upper end of the piston bore;

upon increasing a pump pressure shear pins connecting both plugs are sheared to release the inner plug;

the inner plug seats in the piston bore at a second seat;

subsequently cycling the hydraulic JAP jack comprising alternatingly stroking-in and re-setting of the jack, the during which cycling the annular non-return valve is continuously open and the second non-return valve cycles with the jack movement, thereby flushing cement from the bore of the expansion tool string.

In another aspect, there is provided a system for passing cement through a hydraulically actuated JAP expansion tool string comprising:

a JAP tool string comprising a bore, a wall, and a hydraulic JAP jack comprising a piston and cylinder assembly which comprises a piston provided with a piston bore;

an annular non-return valve arranged in the wall of the JAP tool string below the hydraulic JAP jack, which allows mud to flow from a surrounding annulus into the bore of the expansion tool string when the pressure in the bore of the tool string is lower than that in the annulus;

a second non-return valve arranged in an interior of the JAP tool string and below the annular non-return valve, which allows fluid to move only down through the bore from an upper part to a lower part of the interior of the JAP tool string;

a trailing plug assembly comprising an outer and an inner plug which is configured to be pumped behind a cement column;

the outer plug is configured to seat and seal at a first seat at an upper end of the piston bore;

shear pins connecting both plugs that are configured to be sheared to release the inner plug upon increasing the pump pressure with the outer plug seated at the first seat;

the inner plug being configured to seat in the piston at a second seat;

wherein the hydraulic JAP jack can be cycled with the outer plug and inner plug seated in respectively first and second seats, the during which cycling the annular non-return valve is continuously open and the second non-return valve cycles with the jack movement, thereby flushing cement from the bore of the expansion tool string.

These and other features, embodiments and advantages of the expansion method and tool according to the invention are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects. Objects and other features depicted in the figures and/or described in this specification, abstract and/or claims may be combined in different ways by a person skilled in the art.

DETAILED DESCRIPTION OF THE DEPICTED EMBODIMENTS

The following method and system are proposed for inhibiting cement deposition in a jack and pull (JAP) expansion tool string.

Figure 1A:
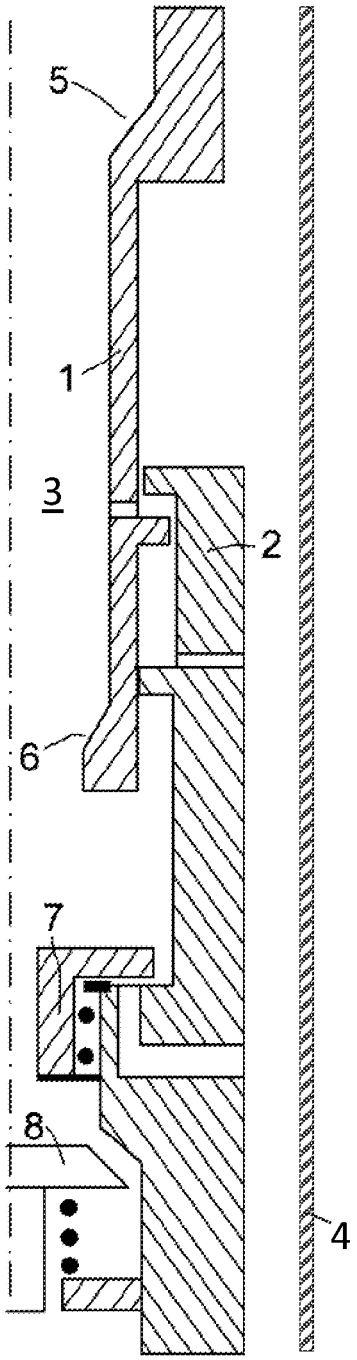
FIGS. 1*a-c* show a jack and plug assembly.

FIG. 1A shows jacking assembly of a Jack And Pull (JAP) expansion tool string, comprising a piston 1 and cylinder 2 assembly which together form a hydraulic JAP jack. The JAP jack can have multiple stages to increase its capacity. The high pressure chambers of the JAP jack are connected to the bore of the piston 3 and the low pressure chambers are connected to the annulus between the casing of the jack and the ID of the expandable liner 4. The piston and cylinder assembly of the JAP jack is provided with a first and a second seat 5, 6 to accommodate the stages of a cement plug.

An annular non-return valve is provided in the wall of the expansion tool string 7. The annular non-return valve allows mud to flow from the annulus around the cylinder 2 to the bore of the expansion tool string when the pressure in the bore of the tool string is lower than that in the annulus. Below the annular valve 7 a second non-return valve 8 is provided in the interior of the tool string which allows fluid to move down only. This can be accomplished by e.g. a flapper valve.

Figure 1B:
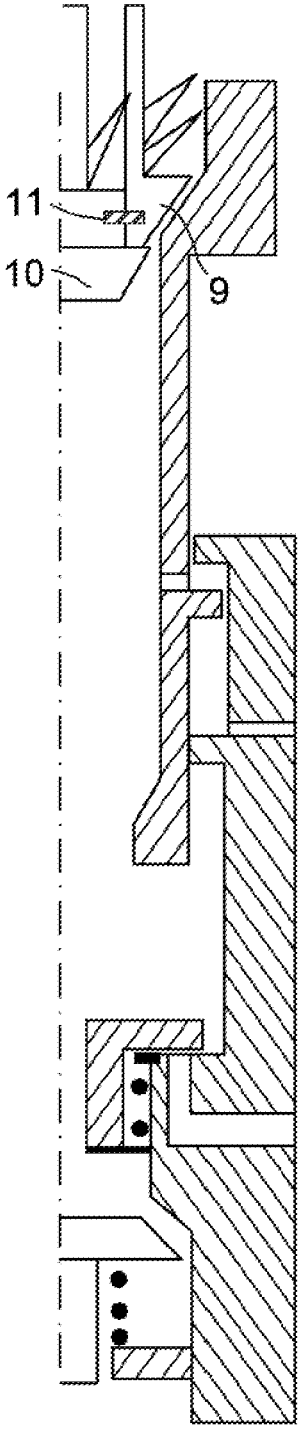
Figure 1C:
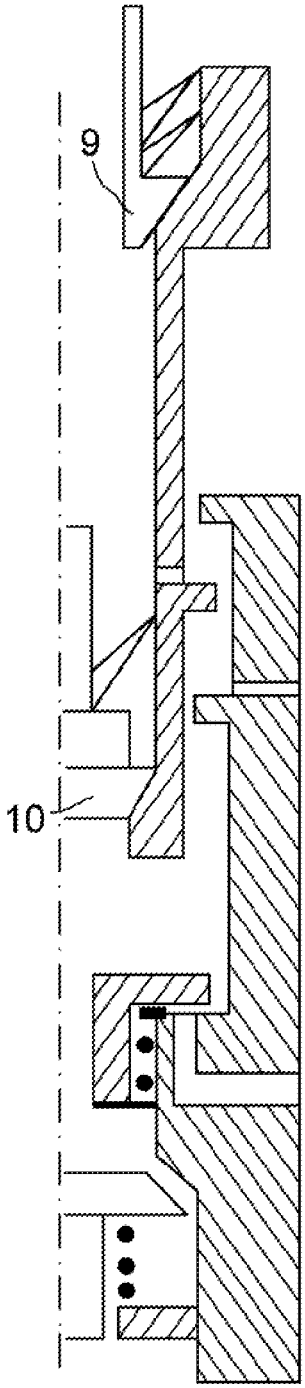

FIG. 1*b* illustrates that when cement is pumped a trailing plug assembly comprising an outer plug 9 and an inner plug 10 is pumped behind the cement column. The outer plug seats and seals at the first seat 5. Upon increasing the pump pressure the shear pins 11 connecting both plugs are sheared to release the inner plug 10. This plug will seat in the bore of the piston of the jack at the second seat 6, as illustrated in FIG. 1*c*.

Figure 2A:
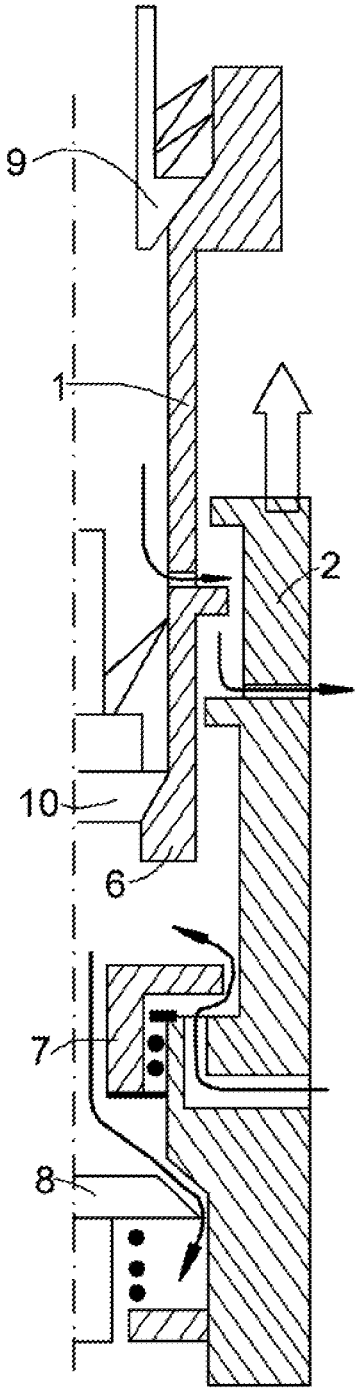
FIGS. 2*a* and 2*b* show mud flow during cycling of the jack of FIG. 1.

FIG. 2 shows the mud flow during cycling of the jack. FIG. 2*a* illustrates stroking-in. Once the bore of the expansion tool string is closed, the jack is stroked-in by applying pressure in the expansion tool string. During the stroking of the jack the cone moves up and a swabbing pressure is created in the bore of the expansion tool string provided the volume created by the cone during the expansion stroke is larger the volume of the piston that enters the lower part of the expansion tool string during the stroking of the jack. This swabbing pressure opens the annular non-return valve 7 and the second non-return valve 8 to allow mud to flow through the bore of the expansion tool string so as to fill up the volume created by the cone during its stroke.

Figure 2B:
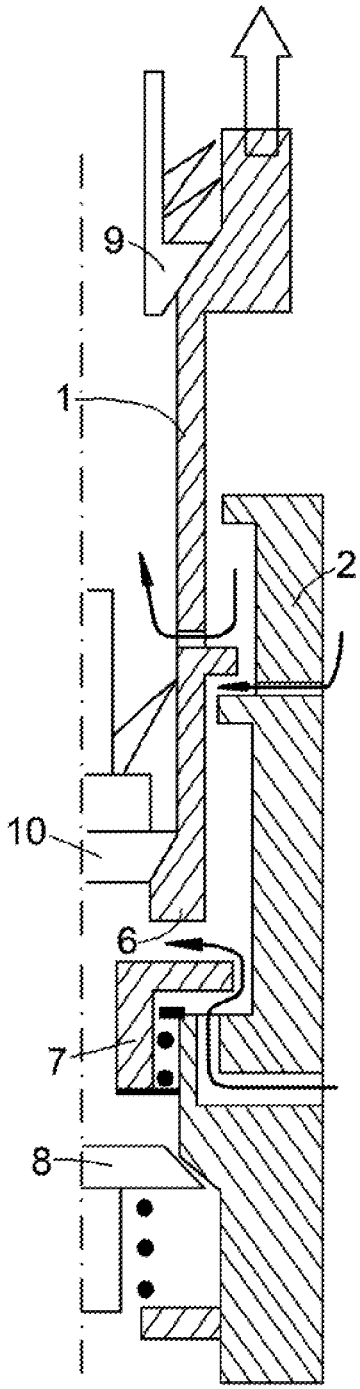

FIG. 2*b* illustrates re-setting of the jack. During re-setting of the jack the mud pumped into the high pressure chambers of the jack flows back into the bore of the expansion tool string and the low pressure chambers are filled up again from the annulus around the casing of the jack. The mud volume required to fill up the volume of the piston of the jack is sucked in via the annular non-return valve 7 from the annulus around the jack.

The above process implies that during the cycling of the jack the annular non-return valve 7 is continuously open and the non-return valve in the bore of the expansion tool string cycles with the jack movement. The result of this cycling is a continuous mud flow through the lower part of the bore of the expansion tool string towards the area below the cone. This enables the lower part of the expansion tool string to be flushed with mud and any cement remains to be removed from the tool string and dumped in the area below the cone, thereby inhibiting curing of cement in the expansion tool string.

Therefore, the method, system and/or any products according to present invention are well adapted to attain the ends and advantages mentioned as well as those that are inherent therein.

In summary, proposed herein is a method for inhibiting cement deposition in a hydraulically actuated Jack And Pull (JAP) tubular expansion tool string, the method comprising:

arranging an annular non-return valve 7 in the wall of the JAP string, which allows mud to flow from a surrounding annulus into the bore of the expansion tool string when the pressure in the bore of the tool string is lower than that in the annulus;

arranging in the JAP string below the annular non-return valve 7 a second non-return valve 8, which allows fluid to move down only;

wherein during the cycling of a JAP jack the annular non-return valve 7 is continuously open and the second non-return valve 8 cycles with the jack movement, thereby inhibiting curing of cement in the expansion tool string;

when cement is pumped a trailing plug assembly comprising an outer plug 9 and an inner plug 10 is pumped behind the cement column;

the outer plug subsequently seats and seals at a first seat 5;

upon increasing the pump pressure shear pins 11 connecting both plugs are sheared to release the inner plug 10;

the inner plug 10 seats in a bore of a piston of the jack at a second seat 6.

Optionally, the cycling of the JAP jack comprises:

stroking the JAP jack thereby moving an associated expansion cone up and creating a swabbing pressure in a bore of the expansion tool string, which swabbing pressure opens the non-return valve 7 and the non-return valve 8 to allow mud to flow through the bore of the expansion tool string so as to fill up the volume created by the cone during its stroke; and re-setting the JAP jack thereby inducing the mud pumped into the high pressure chambers of the jack to flow back into the bore of the expansion tool string and filling the low pressure chambers up again from the surrounding annulus, wherein the mud volume required to fill up the volume of the piston of the jack is sucked in via the annular non-return valve 7 from the annulus around the jack.

The cycling may generate a continuous mud flow through the lower part of the bore of the expansion tool string towards the area below the expansion cone thereby enabling the lower part of the expansion tool string to be flushed with mud and any cement remains to be removed from the tool string and dumped in the area below the cone.

There is furthermore provided a hydraulically actuated Jack And Pull (JAP) tubular expansion tool string comprising:

an annular non-return valve arranged in the wall of the JAP string 7, which allows mud to flow from a surrounding annulus into the bore of the expansion tool string when the pressure in the bore of the tool string is lower than that in the annulus;

a non-return valve 8 arranged in the JAP string below the annular valve 7, which allows fluid to move down only;

a trailing plug assembly comprising an outer 9 and an inner 10 plug which is configured to be pumped behind the cement column;

the outer plug is configured to seat and seal at a first seat 5;

shear pins 11 connecting both plugs that are configured to be sheared to release the inner plug 10 upon increasing the pump pressure;

the inner plug 10 is configured to seat in a bore of a piston of the jack at a second seat 6.

Optionally the JAP tubular expansion tool string further comprises a cyclic mud injection system which, when in use: A) strokes a jack of the JAP string thereby moving an associated expansion cone up and creating a swabbing pressure in a bore of the expansion tool string, which swabbing pressure opens the annular non-return valve 7 and the second non-return valve 8 to allow mud to flow through the bore of the expansion tool string so as to fill up the volume created by the cone during its stroke; and B) re-sets the jack thereby inducing the mud pumped into the high pressure chambers of the jack to flow back into the bore of the expansion tool string and filling the low pressure chambers up again from the surrounding annulus, wherein the mud volume required to fill up the volume of the piston of the jack is sucked in via the annular non-return valve 7 from the annulus around the jack.

The particular embodiments disclosed above are illustrative only, as the present invention may be modified, combined and/or practiced in different but equivalent manners apparent to those skilled in the art having the benefit of the teachings herein.

Furthermore, no limitations are intended to the details of construction or design herein shown, other than as described in the claims below.

It is therefore evident that the particular illustrative embodiments disclosed above may be altered, combined and/or modified and all such variations are considered within the scope of the present invention as defined in the accompanying claims.

While any methods, systems and/or products embodying the invention are described in terms of "comprising," "containing," or "including" various described features and/or steps, they can also "consist essentially of" or "consist of" the various described features and steps.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

Also, the terms in the claims have their plain, ordinary meaning unless otherwise explicitly and clearly defined by the patentee.

Moreover, the indefinite articles "a" or "an", as used in the claims, are defined herein to mean one or more than one of the element that it introduces.

If there is any conflict in the usages of a word or term in this specification and one or more patent or other documents that may be cited herein by reference, the definitions that are consistent with this specification should be adopted.

What is claimed is:

1. A method for passing cement through a hydraulically actuated Jack And Pull (JAP) expansion tool string, the method comprising:

providing a JAP tool string comprising a bore, a wall, and a hydraulic JAP jack comprising a piston and cylinder assembly which comprises a piston provided with a piston bore;

arranging an annular non-return valve in the wall of the JAP tool string below the piston of the hydraulic JAP jack, which allows mud to flow from a surrounding annulus into the bore of the JAP tool string below the piston, when the pressure in the bore of the JAP tool string is lower than that in the surrounding annulus;

arranging in an interior of the JAP tool string, and below the annular non-return valve, a second non-return valve, which allows fluid to move only down through the bore from an upper part to a lower part of the interior of the JAP tool string;

pumping a cement column comprising cement though the bore JAP tool string and the piston bore;

when the cement column is pumped, pumping a trailing plug assembly comprising an outer plug and an inner plug connected to each other by means of shear pins behind the cement column and towards a first seat at an upper end of the piston bore;

subsequently sealingly seating the outer plug at the first seat;

shearing the shear pins connecting both plugs by increasing a pump pressure, to release the inner plug from the outer plug;

allowing the inner plug to advance to a second seat in the piston bore at a lower end of the piston;

seating the inner plug in the piston bore at the second seat;

subsequently cycling the hydraulic JAP jack comprising alternatingly stroking-in and re-setting of the jack, the during which cycling the annular non-return valve is continuously open and the second non-return valve cycles with the jack movement, thereby flushing cement from the bore of the expansion tool string.

2. The method of claim 1, wherein during stroking-in mud enters through the annular non-return valve into the bore below the seated inner plug and passes through the second non-return valve to allow mud to flow through the bore of the expansion tool string.

3. The method of claim 2, wherein during re-setting the second non-return valve closes and mud is sucked in via the annular non-return valve.

4. A system for passing cement through a hydraulically actuated Jack And Pull (JAP) expansion tool string comprising:

a JAP tool string comprising a bore, a wall, and a hydraulic JAP jack comprising a piston and cylinder assembly which comprises a piston provided with a piston bore, wherein a first seat is configured in the piston bore at an upper end of the piston bore and a second seat is configured in the piston bore at a lower end of the piston;

an annular non-return valve arranged in the wall of the JAP tool string below the piston of the hydraulic JAP jack, which allows mud to flow from a surrounding annulus into the bore of the expansion tool string below the piston, when the pressure in the bore of the tool string is lower than that in the annulus;

a second non-return valve arranged in an interior of the JAP tool string and below the annular non-return valve, which allows fluid to move only down through the bore from an upper part to a lower part of the interior of the JAP tool string;

a trailing plug assembly comprising an outer plug and an inner plug connected to each other by means of shear pins, which trailing plug is configured to be pumped behind a cement column;

the outer plug is configured to seat and seal at the first seat;

said shear pins connecting both plugs are configured to be sheared to release the inner plug upon increasing the pump pressure with the outer plug seated at the first seat whereby the inner plug is free to advance to the second seat;

the inner plug being configured to seat in the piston bore at the second seat;

wherein the hydraulic JAP jack can be cycled with the outer plug and inner plug seated in respectively first and second seats, the during which cycling the annular non-return valve is continuously open and the second non-return valve cycles with the jack movement, thereby flushing cement from the bore of the expansion tool string.

* * * * *